US005617067A

United States Patent [19]

Arora et al.

[11] Patent Number: 5,617,067

[45] Date of Patent: Apr. 1, 1997

[54] ELECTROMAGNETIC ACTUATOR HAVING A LOW ASPECT RATIO STATOR

[75] Inventors: Ram S. Arora, Farmington Hills; Walter K. O'Neil, Birmingham; Bryce A. Buuck, Bellevue, all of Mich.

[73] Assignee: Eaton Corporation, Cleveland, Ohio

[21] Appl. No.: 568,841

[22] Filed: Dec. 7, 1995

[51] Int. Cl.[6] ..... H01H 51/22

[52] U.S. Cl. ..... 335/78; 335/80; 335/132

[58] Field of Search ..... 333/78–86, 124, 333/128, 131–3

[56] References Cited

U.S. PATENT DOCUMENTS 5,321,377 6/1994 Aharonian ..... 335/128

5,325,079 6/1994 Aharonian ..... 335/80

5,455,550 10/1995 Von Alten et al. ..... 335/78

*Primary Examiner*—Lincoln Donovan

*Attorney, Agent, or Firm*—Loren H. Uthoff, Jr.

[57] ABSTRACT

An electromagnetic actuator having a coil, stator and an armature where dual parallel channels are formed in the stator for receiving the coil and where the armature is hinged to the stator for movement toward the stator upon application of an electrical current to the coil. The stator has a length, a width and a height where its length is at least 1.6 times its width and its width is at least 2.0 times its height.

6 Claims, 3 Drawing Sheets

FIG 1
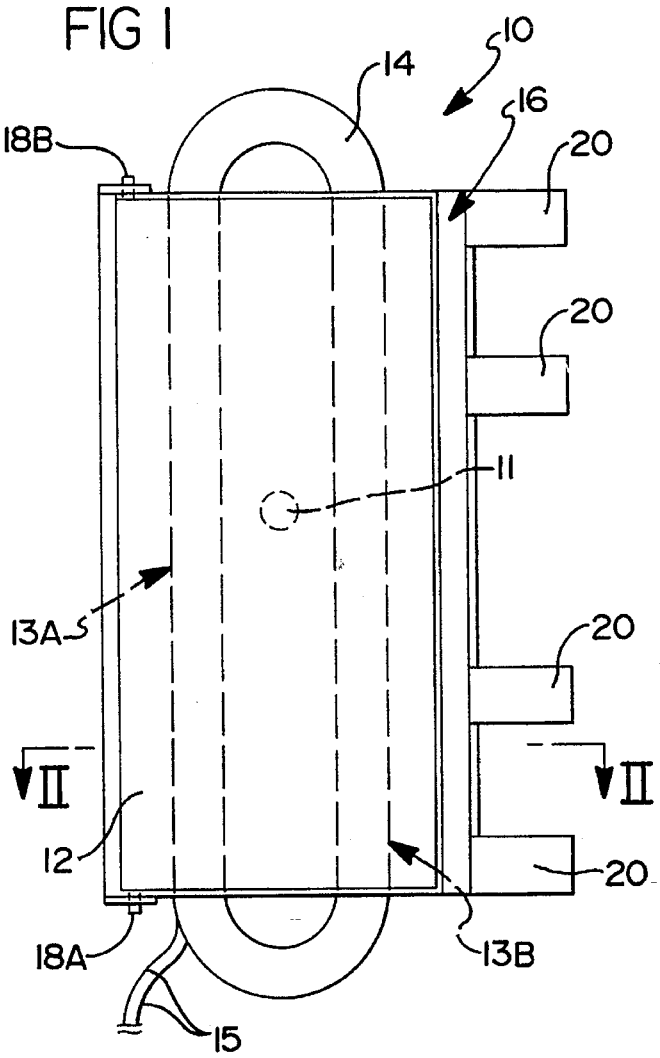
FIG 3
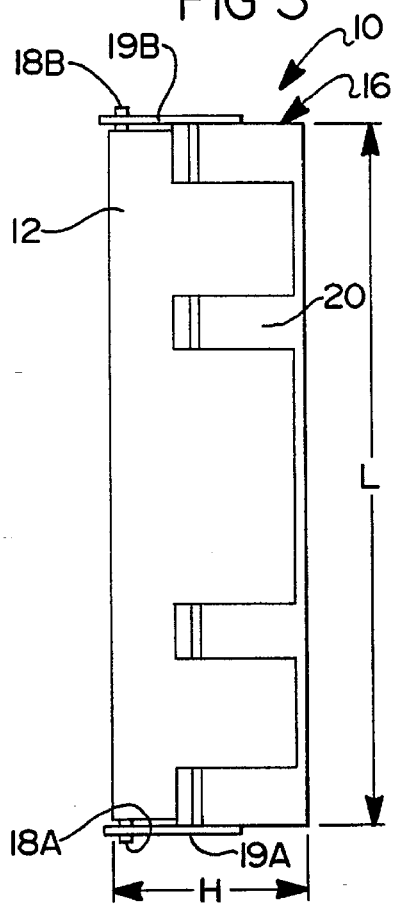
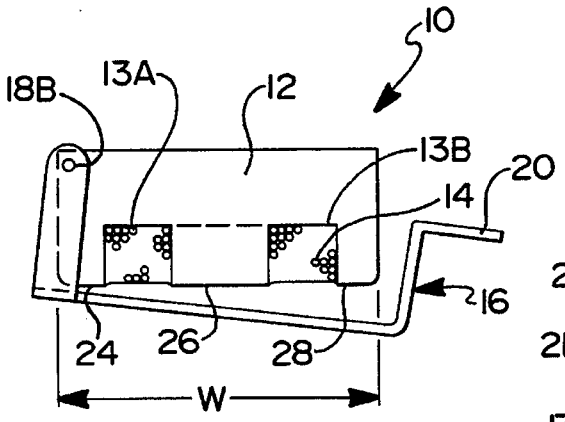
FIG 2
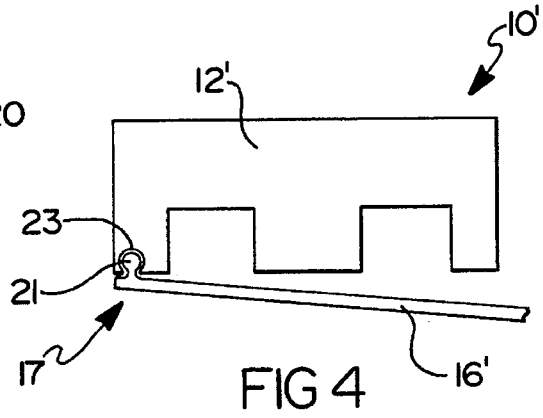
FIG 4

ELECTROMAGNETIC ACTUATOR HAVING A LOW ASPECT RATIO STATOR

BACKGROUND OF THE INVENTION

1. Field of the Invention

The present invention relates to an electromagnetic actuator and in particular to an electromagnetic actuator having an elongated stator for production of high pull in forces.

2. Description of the Prior Art

It is commonly known to use a current introduced into a coil of wire to produce an electromagnetic force which is localized with the addition of an iron core or stator which is used to attract a hinged magnetically active armature in some fashion to provide motion. Traditionally, the coil is cylindrical in shape and fitted over one leg of the stator. For many applications, this particular configuration has proved to be satisfactory. However, it would be desirable to utilize a different coil and stator shape for the actuator to provide an increase in draw-in force at the moveable armature for performing a variety of tasks. In the prior art, a relay is formed with an armature and a magnetic assembly where the armature is connected to one or more electrical contacts which require a relatively low force to make and to break a connection. However, for use in other applications other than cylindrical relays, much higher force levels and/or increased travel is required to perform the necessary motion.

The electromagnetic actuator described in U.S. Pat. No. 4,099,151, the disclosure of which is hereby expressly incorporated by reference, discloses a stationary stator structure and a moveable armature structure where the armature is drawn toward the stator using a single coil of electrical wire wrapped around one side of the stator. The coil is formed in a cylindrical shape with an armature hinge point on a support structure. In a similar manner, U.S. Pat. No. 4,447,794 discloses a stator construction where an armature is hinged to be rotated on a second leg of a stator of an electromagnetic actuator where a coil is wound around a first leg with the first leg and second leg being joined to form one electromagnetic conductive path. U.S. Pat. No. 4,447,794 is hereby expressly incorporated by reference. These particular coil and stator constructions do not lend themselves to certain applications where high force and long travel are required of the actuator.

SUMMARY OF THE INVENTION

In the electromagnetic actuator, according to the present invention, the stator is formed having a pair of parallel channels formed along its length for the fitting of a coil, where the length of the stator is at least 1.6 times its width and where its width is at least twice its height (i.e. a low aspect ratio). An armature is pivoted at both ends of the stator at one side and extends across the face of the stator to form an operating air gap across both legs of the coil and across both a first and a second pole opposite that of the side used for the hinge support of the armature. The particular geometry of the stator provides for packaging advantages for select applications and more importantly provides an increased level of actuation force and reduced activation time at a given level of input current to the coil as compared to priority devices. This type of electromagnetic actuator is particularly suitable for use in actuation of a latchable rocker arm as disclosed in patent applications, attorney docket numbers 94-RECD-024; 94-RECD-381 and 94-RECD-450 where in all of these devices a relatively high level of force and travel is required to activate and deactivate the engine rocker arm thereby activating or deactivating the engine valve.

One provision of the present invention is to provide an electromagnetic actuator having a high level of force and increased travel.

Another provision of the present invention is to provide an electromagnetic actuator having a high level of force and increased travel utilizing a stator element having a length which is at least 1.6 times the dimension of its width.

Another provision of the present invention is to provide an electromagnetic actuator having a high level of force and increased travel where its width is at least twice its height.

Another provision of the present invention is to provide an electromagnetic actuator having a high level of force and increased travel where its stator has dual parallel tracks formed therein for holding an electromagnetic coil.

Another provision of the present invention is to provide an electromagnetic actuator having a high level of force and increased travel using an armature hinged to the stator configured to allow movement of the armature toward and away from the stator.

Still another provision of the present invention is to provide an electromagnetic actuator having a high level of force and increased travel for actuation of a latchable rocker arm for use in an internal combustion engine.

BRIEF DESCRIPTION OF THE DRAWINGS

FIG. 1 is an elevational view of the electromagnetic actuator of the present invention;

FIG. 2 is a cross-sectional view of the electromagnetic actuator of the present invention taken along line II—II in FIG. 1 in a non-energized state;

FIG. 3 is a side elevational view of the electromagnetic actuator of the present invention;

FIG. 4 is a partial cross-sectional view of the electromagnetic actuator of the present invention having an alternate embodiment of an armature hinge;

DETAILED DESCRIPTION OF THE PREFERRED EMBODIMENT

Figure 5:
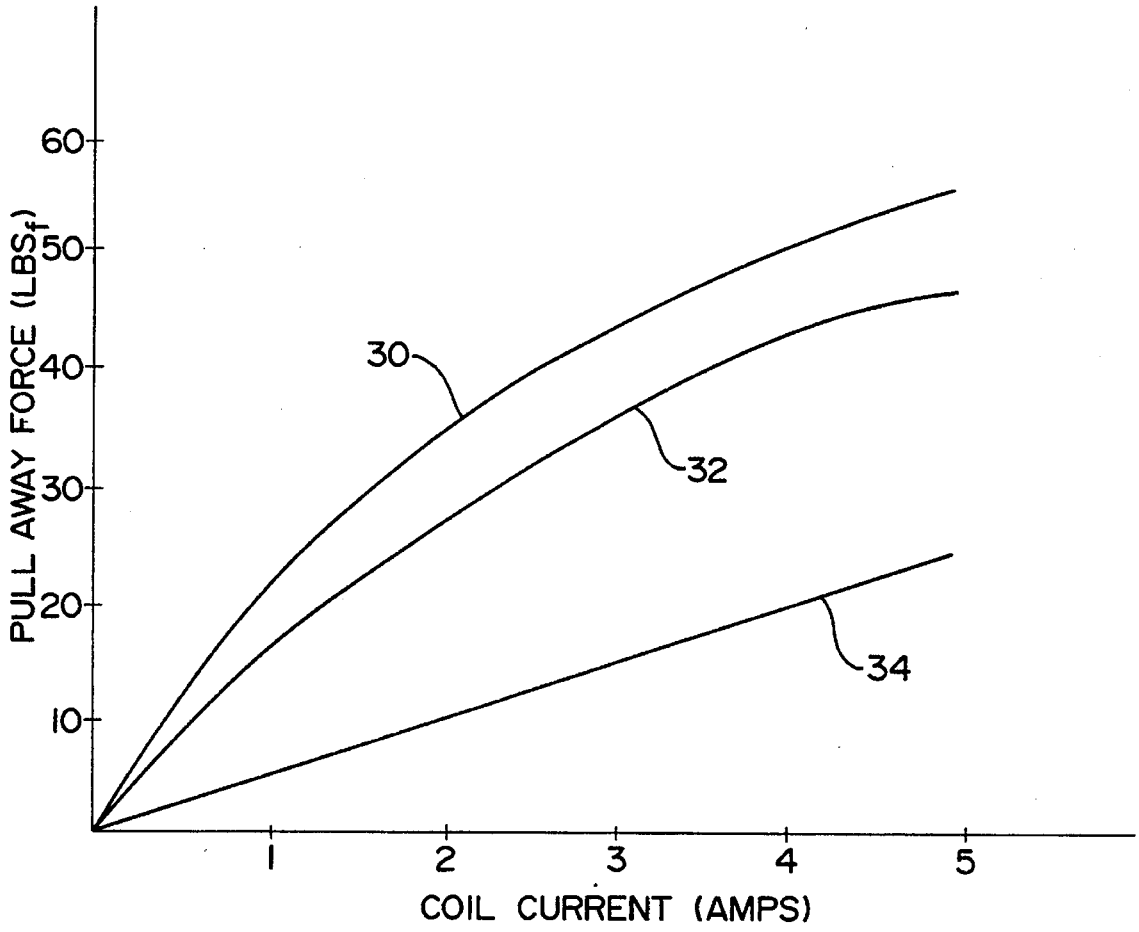
FIG. 5 is a graph of pull away force versus coil current for the electromagnetic actuator of the present invention.

Certain terminology will be used in the following description for convenience in reference only and will not be limiting. The words "upwardly", "downwardly", "rightwardly" and "leftwardly" will designate directions in the drawings to which reference is made. Said terminology will include the words above specifically mentioned, derivatives thereof and words of similar import.

Now referring to FIG. 1 of the drawings, an elevational view of the electromagnetic actuator 10 of the present invention is shown. The stator 12 is made of a magnetic active material such as iron which serves to conduct and focus the strength of the electromagnetic field formed by introducing an electrical current into coil 14 through electrical leads 15 where the coil 14 is made from a multiplicity of turns of insulated wire and secured in place using epoxy glue in two parallel channels 13A and 13B formed in the stator 12. Preferably, the stator 12 is formed using a fabrication process known in the art as extrusion for reasons of low cost and high productivity. If an extrusion forming process is not used, then the ends of the stator 12 can be closed using a section of metal to cover the ends of the coil 14. An armature 16 is rotatably linked to the stator 12 by pivot pins 18A and 18B such that the armature 16 can pivot toward and away from the electromagnetically active surface of the stator 12 as may be more clearly seen by reference to FIG. 2. Armature extensions 20 are formed as part of the armature 16 and are utilized to make contact with another device that is to be moved by the electromagnetic actuator 10 of the present invention such as, for example, a door lock or a latchable rocker arm. A return spring 11 which can be a coil type spring is fitted in the stator 12 extending to contact the armature 16 so as to force the armature 16 away from the stator 12 when the electromagnetic actuator 10 is nonenergized. This spring 11 also functions to prevent the armature from rattling if vibration is present.

Now referring to FIG. 2, a cross-sectional view of the electromagnetic actuator 10 taken along line II—II of FIG. 1 is shown. In FIG. 2, the channels 13A and 13B which provide for insertion of the coil 14 are more clearly shown. While shown with a rectangular cross-section, the channels 13A and 13B could be any selected shape to provide, for example, a coil 14 having a circular cross-section. The armature 16, having armature extensions 20, is shown hinged on the stator 12 at pivot pins 18A and 18B in such a manner that the armature 16 can rotate on pivot pins 18A and 18B so as to move toward and contact the stator 12 in response to the electromagnetic forces generated when a current is provided to the coil 14. Thus, in its nonenergized state, as shown in FIG. 2, the armature 16 is moved away from the stator poles 24, 26 and 28 by either a return spring on the device that is to be moved by the electromagnetic actuator 10 and/or using a return spring 11 that acts to force the armature 16 away from the stator 12. As electrical current is introduced into coil 14, an electromagnetic field is generated in the stator 12 and specifically at the stator poles 24, 26 and 28 which magnetically attract the armature 16 and cause it to rapidly move to contact the stator 12. The armature extensions 20 can be used to activate a motion transfer device such as a bellcrank, or directly act against another device such as a latchable rocker arm in an internal combustion engine.

In the preferred embodiment, the armature 16 is chrome plated to a thickness of approximately 0.005 inches to improve the wear resistance of the armature extensions 20 and more importantly to provide a nonmagnetic coating on the surface of the armature 16 to prevent direct magnetic contact between the armature 16 and the stator 12 when the electromagnetic actuator 10 is energized. This small air gap between the armature 16 and the stator 12 prevents the buildup of eddy current forces which slow the opening of the electromagnetic actuator 10 when the electrical current to the coil 14 is stopped. Other prior art techniques such as a nonmagnetic shim can be utilized to provide this minimum air gap between the armature 16 and the stator 12.

Now referring to FIG. 3 in the drawings, a side elevational view of the electromagnetic actuator 10 of the present invention is shown. The stator 12, which can be fabricated from a variety of electromagnetic materials, is used to rotatably support the armature 16 also fabricated from an electromagnetic active material by way of pivot pins 18A and 18B one at a respective end of the stator 12. The coil 14 is centered within the stator 12 lying in the channels 18A and 18B as herein before described in reference to FIGS. 1 and 2. The armature extensions 20 are spaced along the length of the armature 16 and provide the necessary geometry to actuate two of the latchable rocker arms (see FIG. 6) in an internal combustion engine using only a single coil 14. This type of coil 14, stator 12 and armature 16 configuration provides for an electromagnetic actuator with high force and fast response which has the necessary geometry to allow convenient packaging for the actuation of two latchable rocker arms when applied to such a device mounted on an internal combustion engine (see FIG. 6). This particular geometry has its iron circuit biased toward the stator pole 28 for optimization of the pull-in force per amp input current, a low hold in current, energy efficiency and rapid response. Also, this particular configuration is amiable to low cost manufacture since an open ended design having double parallel channels 13A and 13B provides for the successful extrusion of the stator 12.

The length L of the stator 12 is at least 1.6 times that of the width W of the stator as illustrated in FIGS. 2 and 3. In addition, the width W of the stator 12 is at least twice its height H. This particular configuration provides for a significantly higher draw-in force of the armature 16 toward the stator 12 upon application of an electrical current to the coil 14. Likewise, the armature 16 is similarly designed where its length is at least 1.6 times its width.

FIG. 4 is a cross-sectional view similar to FIG. 2, where an alternate embodiment for the armature hinge 17 is shown. A semi-circular groove 23 is formed in the first end of the stator 12' coaxial along the length of the stator 12' for receiving a protruding portion 21 formed as part of the armature 16'. This armature hinge 17 replaces the pivot pins 18A and 18B and provides improved magnetic performance by reducing the overall level and the variation in the magnetic reluctance of the electromagnetic actuator 10' as the armature 16' is moved toward and away from the stator 12'. Also, armature hinge 17 is more robust in that it can withstand high levels of vibration such as those experienced when mounted on an internal combustion engine. The disadvantage to armature hinge 17 is its increased expense in manufacture due to the increased machining required to form the groove 23 and the protruding section 21 which both extend along the length of the stator 12' and armature 16' respectively.

Now referring to FIG. 5, a graph showing the actuator armature 16 pull away force versus input electrical current to the coil 14 for various air gaps between the armature 16 and the stator 12 is shown. The actuator tested had a length of 95 mm, a width of 50 mm and a height of 16 mm using a coil 14 having 190 turns of 23 AWG electrical wire. FIG. 5 illustrates the performance of the electromagnetic actuator 10 of the present invention when the coil 14 is powered by an electrical current at selected levels of amperage shown on the abscissa and the pull away force in pounds force is shown on the ordinate. Curve 30 shows the relationship between coil current and pull away force when the armature 16 is in contact with the stator 12. The maximum coil current at 300 degrees F. is 3.37 amps at 12 volts. Curve 32 illustrates the armature 16 pull away force of the electromagnetic actuator 10 at various electrical currents at an armature air gap between the armature 16 and the stator 12 of 0.030 inches. Curve 34 shows the pull away force versus coil current at an operating air gap between the armature 16 and the stator 12 of 0.085 inches.

These performance curves 30, 32 and 34 clearly show the operational advantages of the electromagnetic actuator 10 of the current invention in that significantly higher pull away force is generated at a given coil circuit as compared to prior art actuators.

For this particular geometry of the electromagnetic actuator, the width W is approximately 3 times the height H and the length L is approximately 1.9 times the width. Similar operational advantages can be realized with a length L 1.6 times the width W and the width W being twice the height H.

Figure 6:
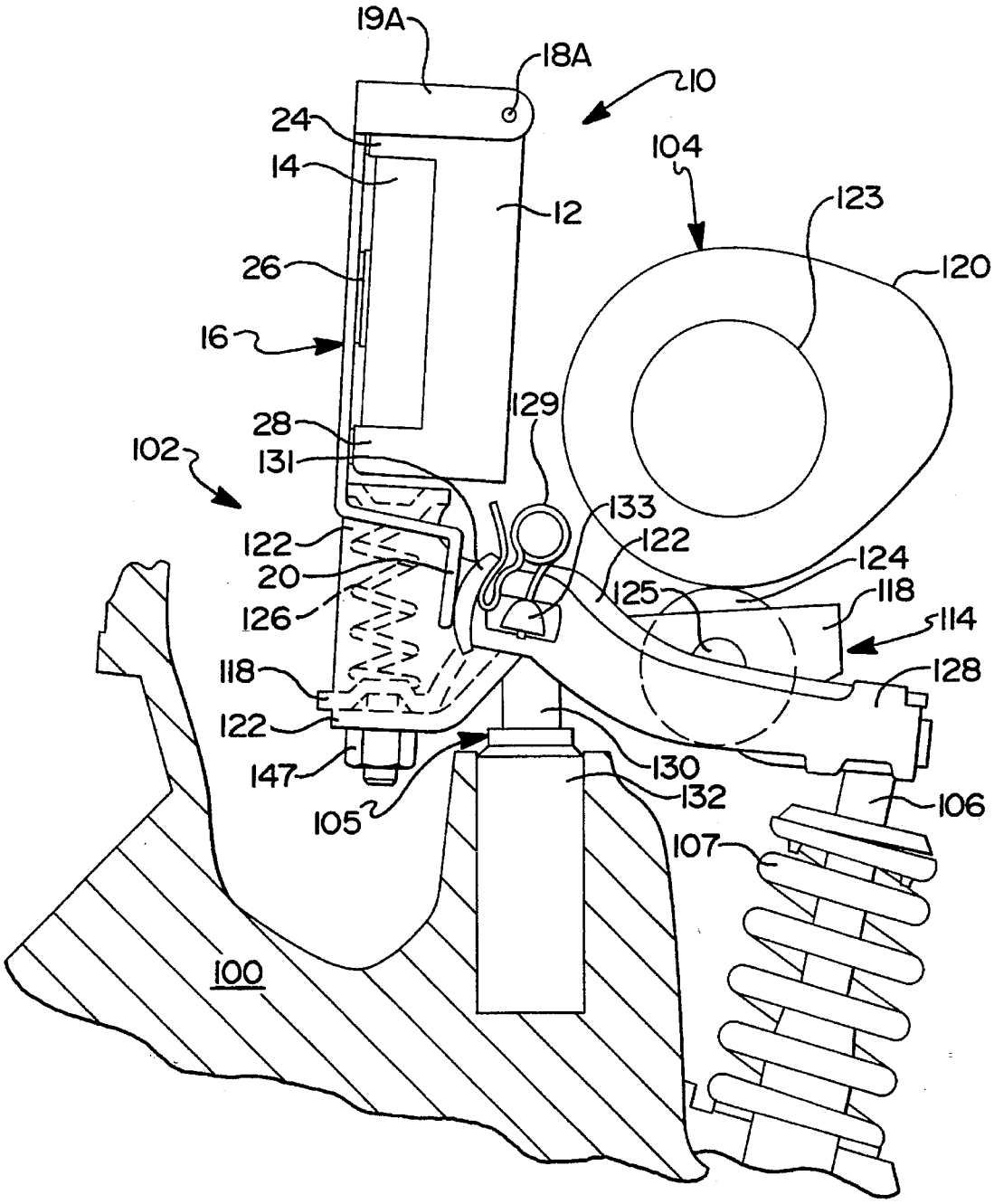
FIG. 6 is a cross-sectional view of the electromagnetic actuator of the present invention mounted on an engine latchable rocker arm assembly.

Now referring to FIG. 6 of the drawings, a cross-sectional view of an engine poppet valve control system 102 with the electromagnetic actuator 10 of the present invention installed as part of the valve train on an internal combustion engine is shown. A portion of an engine cylinder head 100 of an internal combustion engine of the overhead cam type is shown along with the camshaft 104, the hydraulic lash adjuster 105, the engine poppet valve 106, the valve spring 107 and the valve cover 108. Reference is made to patent application U.S. Ser. No. 08/540,280 filed Oct. 6, 1995 entitled "Engine Valve Control System Using A Latchable Rocker Arm", the disclosure of which is hereby incorporated by reference.

As illustrated herein, the engine poppet valve control system 102 is of the type which is particularly adapted to selectively activate or deactivate an engine poppet valve 106 and comprises a rocker arm assembly 114 which is shiftable between an active mode wherein it is operable to open the engine poppet valve 106, and an inactive mode wherein the valve is not opened; and an actuator assembly 116 which is operable to shift the rocker arm assembly 114 between its active and inactive modes through activation and deactivation of the electromagnetic actuator 10.

The rocker arm assembly 114 comprises an inner valve arm 118 which is engageable with the valve actuating camshaft 104 at the cam lobe 120 supported on the cam base shaft 23 and the cylinder head 110 of the engine, and outer rocker arm 122 which is engageable with engine poppet valve 106 which is maintained normally closed by a valve spring 107, a biasing spring 126 acting between the inner and outer rocker arms 118 and 122 to bias the inner rocker arm 118 into engagement with the camshaft 104 through the roller follower 124 and the outer rocker arm 122 into engagement with the plunger 130 which rides in the main body 132 of the lash adjuster 105. The construction and the function of the lash adjuster 105 are well known in the art and will not be described in detail herein. The biasing spring 126 applies sufficient force to the plunder 130 to keep the lash adjuster 105 operating in its normal range of operation at all times.

A latch member 128 is slidably received on the outer rocker arm 122 and biased into a "latched" condition by latch spring 129, the latch member 128 is effective to latch the inner and outer rocker arms 118 and 122 so that they rotate together to define the active mode of the engine poppet valve control system of the present invention when the electromagnetic actuator 10 is deenergized or to unlatch them where the inner and outer rocker arms 118 and 122 are free to rotate relative one to the other to define the inactive mode when the electromagnetic actuator 10 is energized. A link pin 133 passes through coaxial apertures formed in the inner and outer rocker arms 118 and 122 and through an elongated aperture formed in the latch member 128 and provides a pivotal support to the outer rocker arm 122 where the inner rocker arm 118 pivots on the lash adjuster 105. In the preferred embodiment of the invention, the inner rocker arm 118 is pivotally mounted on the plunger 130 and the outer rocker arm 122 is pivotally mounted on the link pin 133 which is supported by the inner rocker arm 118 and indirectly by the plunger 130 of the lash adjuster 105.

A nonenergized electromagnetic actuator assembly 10 of the present invention allows the latch spring 129 to force the latch member 128 into a position to provide actuation of the engine poppet valve 105 by the camshaft 104 through the rocker arm assembly 114 known as the active mode. When the electromagnetic actuator 10 is energized, the armature extensions 20 push against the latch shoes 131 thereby forcing the latch member 128 into a position to provide for a loss motion between the inner and outer rocker arm 118 and 122 so that there is no mechanical actuation of the engine poppet valve 106 by the camshaft 104 known as the inactive mode as shown in FIG. 5.

The armature 16 moves to contact the stator 12 and the armature extensions 20 move to apply a force against the latch shoes 131. As soon as the latch member 128 becomes unloaded, the electromagnetic actuator 10 forces it into a position so that the rocker arm assembly 114 is in the inactive mode. The armature extension 20 contacts the latch member 128 at latch shoes 131 which are formed as part of the latch member 128 where the contact mechanism is biased toward a position to activate the engine poppet valve 106 (active mode) by the latch spring 129 which acts upon the latch shoe 131 and is secured at one end through holes formed in the link pin 133.

The biasing spring 126 is preloaded to maintain a load between the roller follower 124 rotating on roller pin 125 and the camshaft 104 sufficient to keep the lash adjuster 105 operating in its normal range of adjustment. Changes in the preload on the biasing spring 26 can be made by changing the position of the preload adjuster 147.

FIG. 6 illustrates the valve control system 102 in an inactive position where the electromagnetic actuator assembly 10 is energized and the armature 16 is magnetically attracted and moved to come in contact with the stator 12. If the rocker arm assembly is in an unloaded condition where the cam lobe 120 is contacting the roller follower 124 on the base circle, than the latch member 128 is moved against latch spring 129 so as to cause the inner rocker arm assembly 118 to become disconnected from the outer rocker arm assembly 122 so that the engine poppet valve 106 remains closed (i.e. inactive mode).

Although the present invention has been described in its preferred form with a certain degree of particularity, it is understood that the present disclosure of the preferred form has been made only by way of example in that numerous changes of detail of the construction, combination and arrangement of parts may be resorted to without departing from the spirit and the scope of the invention as hereinafter claimed.

We claim:

1. An electromagnetic actuator comprising:

a stator having two parallel channels formed therein, where said stator has length and width and a height where said length is at least 1.6 times said width and where said width is at least 2.0 times said height, said channels being coaxial with said length;

a coil adapted to engage said channels for inducing a magnetic field in said stator upon application of an electrical current into said coil;

an armature hinged to said stator to contact said stator upon application of said electrical current and to swing away from said stator upon removal of said electrical current.

2. The electromagnetic actuator of claim 1, wherein said armature is hinged to said stator at a first end and a second end.

3. The electromagnetic actuator of claim 2, further comprising a pair of hinge pins, a first hinge pin positioned in said stator at said first end and a second hinge pin positioned in said stator at said second end, each of said hinge pins rotatably supporting said armature.

4. The electromagnetic actuator of claim 2, wherein a semi-circular groove is formed in said stator adapted to rotatably receive a protruding portion formed on said armature.

5. The electromagnetic actuator of claim 1, wherein said armature has a length and a width wherein said length is at least 1.6 times said width.

6. The electromagnetic actuator of claim 1, wherein said armature extends beyond said stator forming an armature extension for contacting and actuating a latchable rocker arm in an internal combustion engine.

* * * * *